US005255605A

United States Patent [19]

Pfisterer

[11] Patent Number: 5,255,605

[45] Date of Patent: Oct. 26, 1993

[54] SHEET-GRIPPER DEVICE FOR SHEET-FED ROTARY PRINTING PRESSES

[75] Inventor: Alexander Pfisterer, Eppelheim, Fed. Rep. of Germany

[73] Assignee: Heidelberger Druckmaschinen AG, Heidelberg, Fed. Rep. of Germany

[21] Appl. No.: 547,593

[22] Filed: Jul. 2, 1990

[30] Foreign Application Priority Data

Jun. 30, 1989 [DE] Fed. Rep. of Germany ..... 3921474

[51] Int. Cl.[5] ..... B41F 1/30

[52] U.S. Cl. ..... 101/409; 101/408; 271/206

[58] Field of Search ..... 101/408, 409, 410, 411, 101/415.1; 271/268, 204, 205, 206, 277, 82, 314, 264; 294/104, 103.1, 902; 81/421, 424, 185.1, 185.2, 179; 269/249, 257, 258

[56] References Cited

U.S. PATENT DOCUMENTS

| | | | |
|---|---|---|---|
| 4,224,873 | 9/1980 | Wieland | 101/409 |
| 4,227,459 | 10/1980 | Jeschke | 101/415.1 |
| 4,402,266 | 9/1983 | Sugiyama | 101/409 |
| 4,475,459 | 10/1984 | Wanke et al. | 101/410 |
| 4,587,901 | 5/1986 | Gianfranco | 101/415.1 |
| 4,718,342 | 1/1988 | Raab et al. | 101/409 |
| 4,846,061 | 7/1989 | Jeschke et al. | 101/408 |
| 4,864,929 | 9/1989 | Simeth | 101/409 |

FOREIGN PATENT DOCUMENTS

| | | | |
|---|---|---|---|
| 1103352 | 3/1961 | Fed. Rep. of Germany | 101/409 |
| 2836087 | 3/1979 | Fed. Rep. of Germany | 101/409 |
| 3419201 | 1/1985 | Fed. Rep. of Germany | 101/409 |

*Primary Examiner*—Edgar S. Burr
*Assistant Examiner*—Ren Yan
*Attorney, Agent, or Firm*—Herbert L. Lerner; Laurence A. Greenberg

[57] ABSTRACT

A sheet-gripper device for sheet-fed rotary printing presses formed of a sheet gripper and a sheet-gripper seat, the sheet gripper comprising a sheet-gripper head and a gripper screw-on part, the sheet-gripper head being held by friction in the gripper screw-on part so as to be swivellable about a longitudinal axis of the sheet gripper.

10 Claims, 5 Drawing Sheets

SHEET-GRIPPER DEVICE FOR SHEET-FED ROTARY PRINTING PRESSES

The invention relates to a sheet-gripper device for sheet-fed rotary printing presses formed of a sheet gripper and a sheet-gripper seat or support.

A precise setting or adjustment of sheet-gripper devices is essential for effecting a smooth and frictionless transfer of sheets in a rotary printing press. Particular attention is paid to ensuring that the gripper clamping surface of the sheet gripper is aligned as parallel as possible to the sheet-gripper support or seat. Only with such a setting is there any assurance that the sheet will be gripped across the entire surface of the sheet-gripper support and that the sheet gripper will possess its full holding force. Even when slight canting of the gripper clamping surface occurs with respect to the gripper support, the sheet gripper becomes a so-called edge carrier, the sheet is held on one side and may possibly be pushed back on one side. Register errors result therefrom. In extreme cases, due to insufficient holding torque it is also possible for the sheet to become lost inside the printing press. Because the setting or adjustment of the sheet-gripper devices, as well as the readjustment thereof required because of wear, is very labor-intensive and, accordingly, cost-intensive, efforts have been undertaken to make such corrections automatically.

From German Published Non-Prosecuted Application (DE-OS) 37 10 249, a sheet-gripper device has become known wherein a hardened gripper tongue and a gripper tip, the two of which constitute a gripper head, are releasably connected to one another. In order constantly to ensure a parallel positioning of the sheet gripper and the sheet-gripper support or seat, a movable element is disposed between the gripper tongue and the gripper tip. This movable element is either a ball disposed centrically with respect to the sheet-gripper support, or a flexible intermediate layer.

A similar solution to the aforestated problem is proposed in German Patent 35 29 599, wherein the objective, once again, is to align the holding surface of the gripper tip, when the gripper is closed, so that the holding surface is always parallel to the material to be printed and to the gripper support or seat. In this regard, a pressure member with a non-flexible holding surface is attached to the gripper tip above a flexible intermediate layer. The pressure member is centered in a guide of the gripper tip by means of an elevation or knub disposed in the center of the pressure member.

A disadvantage of both proposed solutions is that, each time the sheet gripper grips a sheet, the sheet gripper has to be aligned into its parallel position with respect to the sheet-gripper support or seat, and thereby with respect to the sheet which is to be transported. Consequently, at least in a first instant, the sheet is gripped only by the edge of the gripper (edge carrier). A disadvantage of this is that the sheet is pushed back on one side, thus, the danger arises that it will not be possible for the sheet to be transported in-register through the printing press. In addition, the holding torque of the gripper device varies in the course of the gripping process; only after the sheet gripper has been aligned parallel to the sheet-gripper support or seat, is it possible for the sheet-gripper device to grip the sheet with the preset holding torque.

It is accordingly an object of the invention to provide a sheet-gripper device which overcomes the herein aforementioned disadvantages of the heretofore known devices of this general type and in which a sheet-gripper head and a sheet-gripper support or seat are always disposed parallel to one another during the cyclical gripping process.

With the foregoing and other objects in view, there is provided, in accordance with the invention, a sheet-gripper device for sheet-fed rotary printing presses formed of a sheet gripper and a sheet-gripper seat, the sheet gripper comprising a sheet-gripper head and a gripper screw-on part, the sheet-gripper head being held by friction in the gripper screw-on part so as to be swivellable about a longitudinal axis of the sheet gripper. In accordance with another feature of the invention, there is provided a connecting member for connecting the sheet-gripper head to the gripper screw-on part by a tightening force or friction.

In accordance with a further feature of the invention, there are provided hard-rubber springs carried by at least one of the gripper screw-on parts and the sheet-gripper head for generating friction therebetween.

In accordance with an added feature of the invention, there is provided an axial connecting part rigidly connected to the sheet-gripper head and swivellably mounted in the gripper screw-on part.

In accordance with an additional feature of the invention, there is provided an axial connecting part including an axial connecting part rigidly connected to the gripper screw-on part, and the sheet-gripper head being mounted so as to be swivellable about the connecting part.

In accordance with again another feature of the invention, there is provided a bolt extending transversely to the connecting part and engaging in a slot formed on a side of the sheet gripper.

In accordance with again a further feature of the invention, there are provided means for adjusting the friction or force between the gripper screw-on part and the sheet-gripper head. In accordance with again an added feature of the invention, the sheet-gripper head is replaceable by another sheet-gripper head.

With the objects of the invention in view, there is also provided, in accordance with another aspect of the invention, in a sheet-gripper device for a sheet-fed rotary printing press, a sheet gripper comprising a sheet-gripper head and a holder therefore threadedly secured thereto, the sheet-gripper head being frictionally retained in the holder, and being swivellable about a longitudinal axis of the sheet gripper.

Other features which are considered as characteristic for the invention are set forth in the appended claims.

Although the invention is illustrated and described herein as embodied in a sheet-gripper device for sheet-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
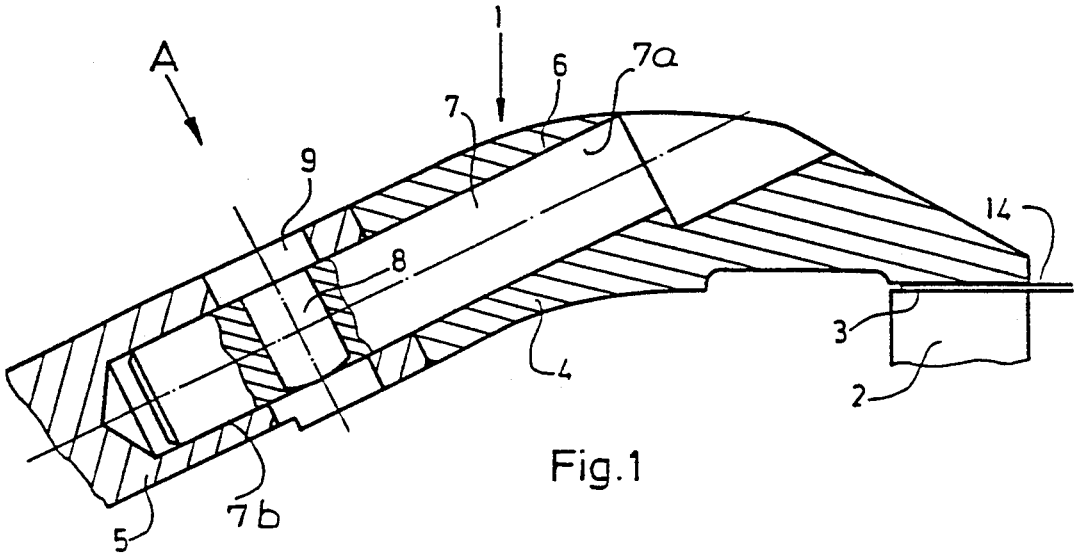
FIG. 1 is a longitudinal sectional view of a first embodiment of the sheet-gripper device for sheet-fed rotary printing presses according to the invention.
Figure 2:
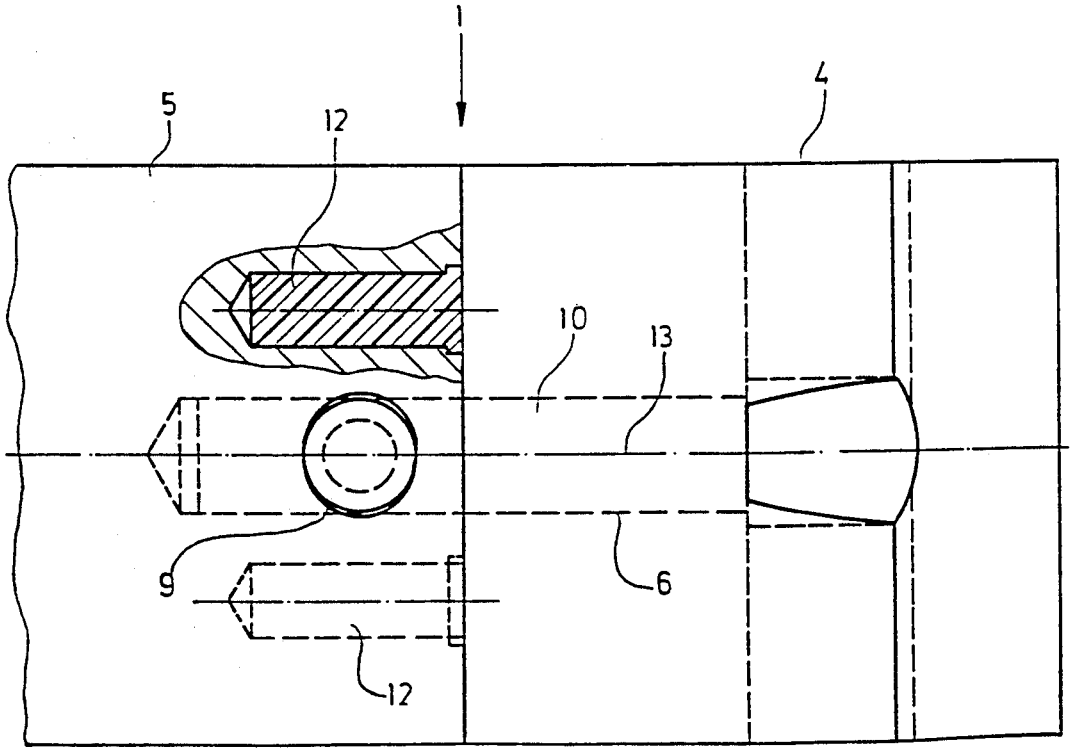
FIG. 2 is a top plan view of FIG. 1, partly broken away and partly in section.

Referring now to the drawing and, first, particularly to FIGS. 1 and 2 thereof, there is shown therein, in a longitudinal sectional view, a first embodiment of the invention. The most important components of the sheet-gripper device are shown in FIG. 1. The sheet-gripper device is composed of a sheet gripper 1 and a sheet-gripper seat or support 2. The sheet gripper 1 itself is formed of a sheet-gripper head 4 and a gripper support or screw-on part 5. Formed on the sheet-gripper 4 is a gripper clamping surface 3 on a portion thereof normally made of hard rubber. The sheet gripper 1 is formed with a bore 6 extending coaxially in the longitudinal direction thereof. One end 7*a* of a bolt 7 is rigidly fastened in the bore 6 of the sheet-gripper head 4. For example, the bolt 7 is bonded i.e. secured by adhesive, in the bore 6, or is secured in the bore 6 by means of a split pin or splint. The other end of 7*b* the bolt 7 is mounted in the gripper screw-on part 5 so that it is able to swivel about the longitudinal axis 13 of the sheet gripper 1. After the gripper clamping surface 3 has been preset parallel to the sheet-gripper support 2, the sheet-gripper head 4 retains this setting throughout its cyclical operation. For this purpose, friction is exerted, for example, with the aid of a suitable fit, on the part of the bolt 7 in the gripper screw-on part 5. As shown in FIG. 2, which is a view in the direction of the arrow A in FIG. 1, it is particularly advantageous to introduce two hard-rubber springs or splines 12, parallel to the bore 6, in the bore 6 of the gripper screw-on part 5. Friction thereby acts between the gripper screw-on, part 5 and the sheet-gripper head 4, the friction force locking the sheet-gripper head 4 in the respective position or setting up to a specific load force determined by the friction torque. The friction force, which can be fixed in a defined manner in this manner, prevents the sheet-gripper head 4 from starting to oscillate about its equilibrium position during the time in which the sheet gripper 1 is swung back. There is no need for re-adjusting the parallel position or setting between the gripper clamping surface 3 of the sheet-gripper head 4 and the sheet-gripper support 2 when the sheet 14 is being gripped; the sheet 14 is gripped immediately by the holding torque that was fixed when the sheet gripper 1 was set, the gripping being effective across the entire support surface of the sheet gripper 1.

An additional advantage is afforded by the automatic readjustment of the parallel position or setting between the gripper clamping surface 3 and the sheet-gripper support 2. There is no need for cost-intensive re-adjustment of the sheet-gripper devices, because the position of the sheet-gripper head 4 and, accordingly, the position of the gripper clamping surface 3 automatically match under load to the changing position or setting of the sheet-gripper support 2.

It has proved to be advantageous to limit the rotation of the bolt 7 and, accordingly, of the sheet-gripper head 4, to a defined angular range. For this purpose, a bolt 8 is applied perpendicularly to the bolt 7 in the longitudinal bore 6, the bolt 8 engaging in an oblong hole or slot 9 formed on the upper side of the gripper screw-on part 5, as viewed in FIG. 1. Thus, by turning the sheet-gripper head 4 relative to the gripper screw-on part 5, the bolt 7 which has been secured to the sheet-gripper head 4, for example, by adhesive, is also turned in the same direction together with the bolt extending transversely through the bolt 7 until the head of the bolt 8, as shown in FIG. 2, is limited in its travel by the surface of the gripper screw-on part 5 which defines the slot or oblong hole 9 formed in the latter. This device prevents the sheet-gripper head 4 from becoming canted i.e. tilted, with respect to the sheet-gripper support 2, form example, by a 90° rotation, if defects should occur on the sheet gripper 1, a condition which would cause considerable damage to the printing press.

Figure 3:
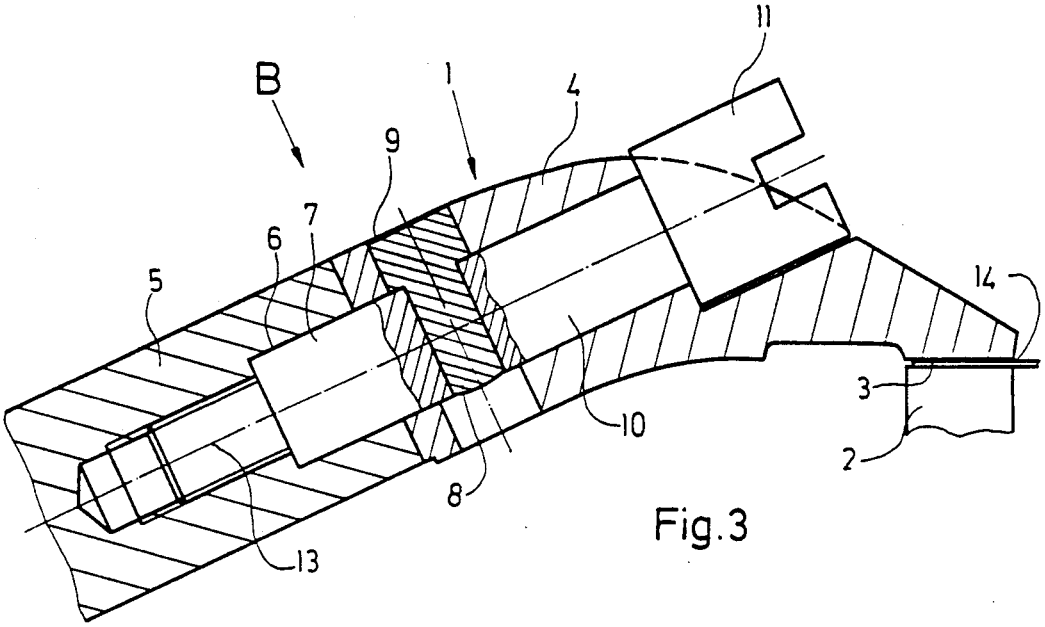
FIG. 3 is a view like that of FIG. 1 of a second embodiment of the invention.

FIG. 3 is a longitudinal sectional view of a second embodiment of the sheet-gripper device according to the invention. In the embodiment, as well, the sheet-gripper device is made up of a sheet gripper 1 and a sheet-gripper support 2. The sheet-gripper 1 itself is formed of a sheet-gripper head 4 and a gripper screw-on part 5. A gripper clamping surface is formed on the sheet-gripper head 4. A bolt 10 is fitted into a coaxial bore 6 formed in the sheet gripper 1. The bolt 10 is firmly connected to the gripper screw-on part 5. The sheet-gripper head 1 is mounted so as to be able to swivel about the bolt 10. The bore 6 formed in the sheet-gripper head 4 is matched to the bolt 10 so that friction torque occurs. A further possibility for locking the sheet-gripper head 4 and the bolted-on gripper part 5 is by holding the sheet-gripper head 4 in the gripper screw-on part 5 with a tightening force through the intermediary of the bolt 10. In this embodiment, as well, a bolt 8 fastened to the bolt 10 and engaging in an oblong hole or slot 9 formed in the upper surface of the sheet-gripper head 4, as viewed in FIG. 3, prevents the oblique or inclined setting or position of the gripper clamping surface 3 of the sheet-gripper head 4 with respect to the sheet-gripper support 2 from exceeding a defined angular range. In order to ensure that the overhang or projection of the bolt head 11, in this construction, does not have a disruptive effect, it is possible, after installation or insertion thereof, to grind the bolt head Il down to the contour of the sheet-gripper head 4.

Figure 4:
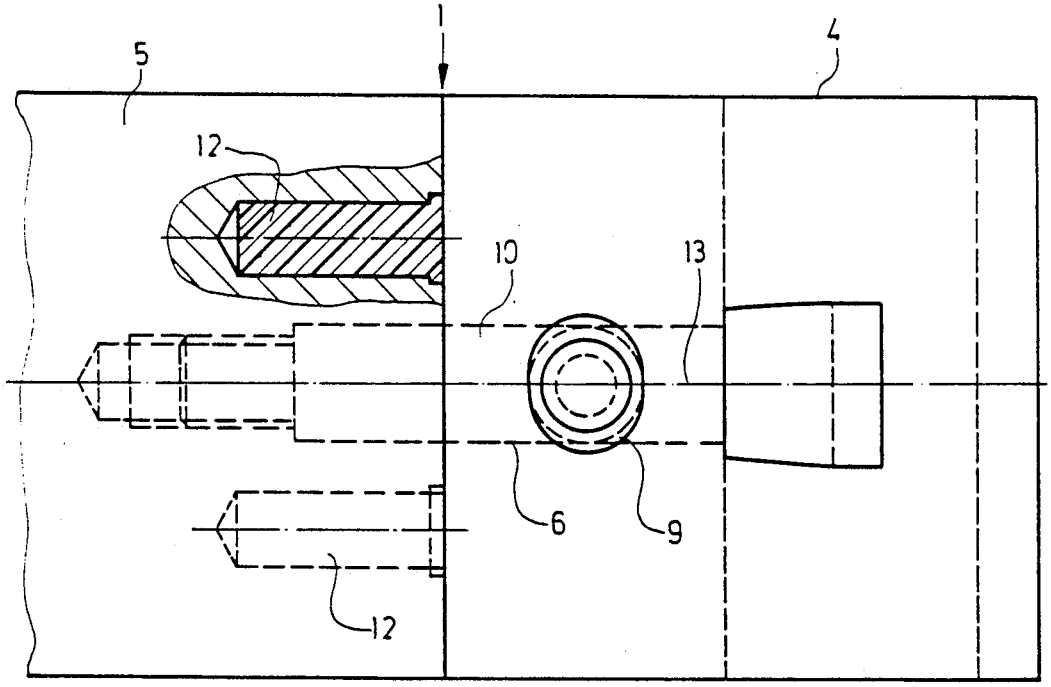
FIG. 4 is a top plan view of FIG. 3.

The top plan view in FIG. 4, which is a view in the direction of the arrow B in FIG. 3, presents a further possibility for locking the gripper in a preset position. It again has proved advantageous to produce a defined friction force between the sheet-gripper head 4 and the gripper screw-on part 5 by means of hard-rubber springs or splints 12, which, in this embodiment, are sunk into the sheet-gripper head 4. Consequently, in this embodiment, as well, a change in the position of the sheet-gripper head 4 occurs only after a specific torque acts upon the sheet-gripper head 4.

In an advantageous third embodiment of the sheet gripper device according to the invention, the friction and starting force between the gripper screw-on part 5 and the sheet-gripper head 4 are adjustable. In this regard, FIGS. 5 and 6 illustrate a modification of the embodiment of the invention shown in FIGS. 1 and 2, while FIGS. 7 and 8 represent a modification of the embodiment of the sheet gripper device according to the invention shown in FIGS. 3 and 4.

Figure 5:
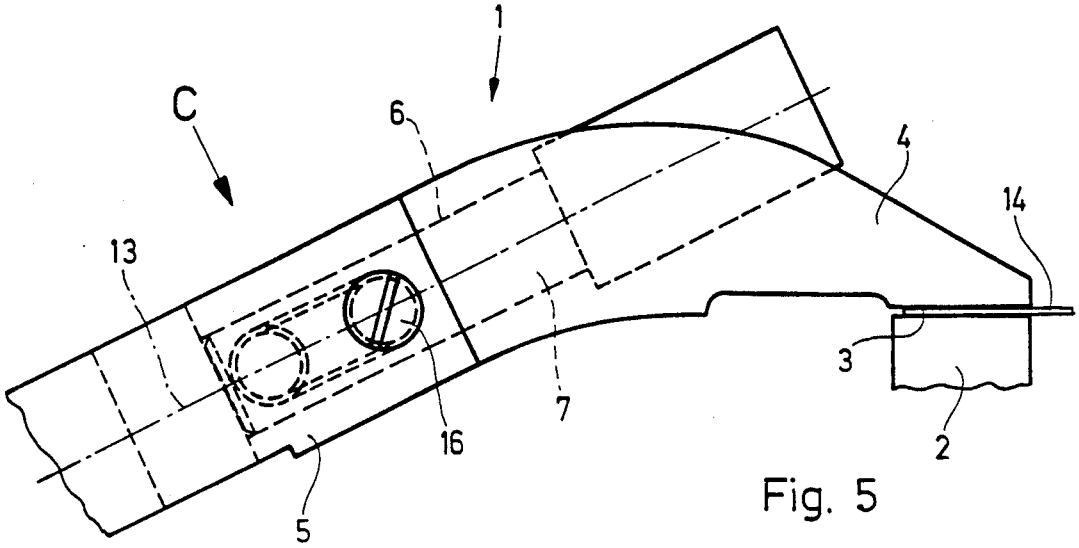
FIG. 5 is a side elevational view of a third embodiment of the invention.
Figure 6:
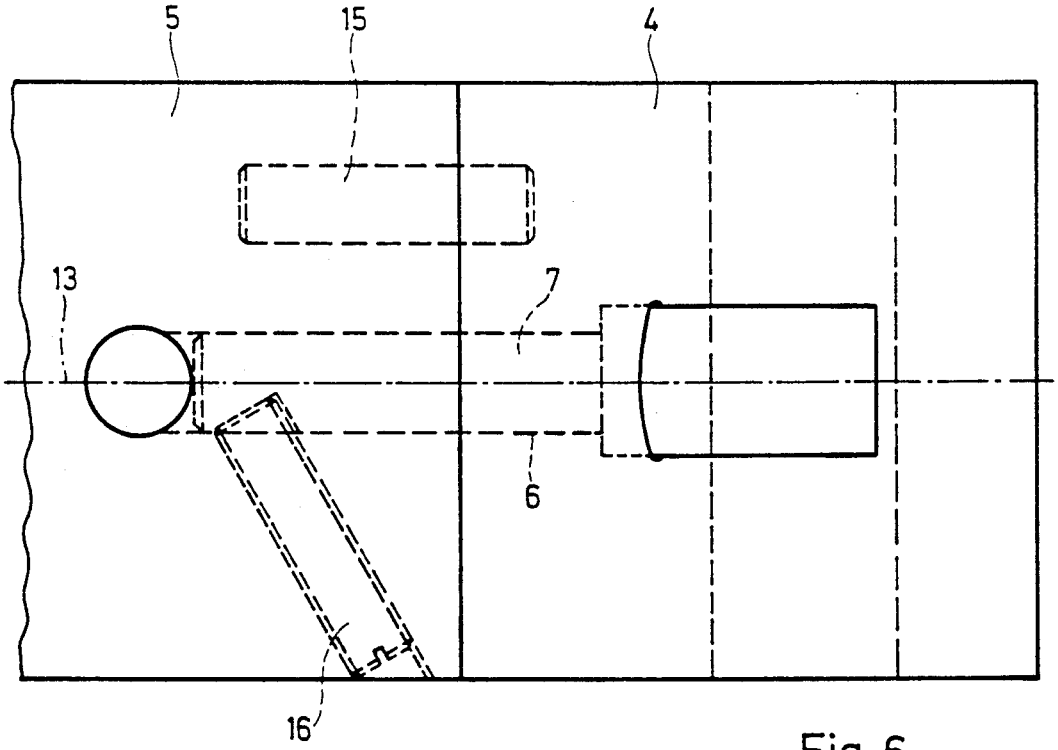
FIG. 6 is a top plan view of FIG. 5.
Figure 7:
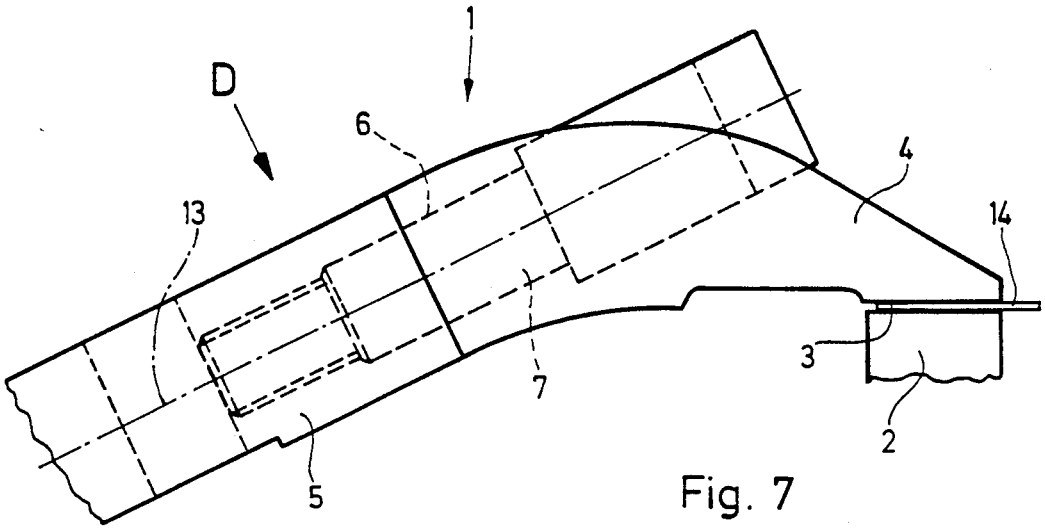
FIG. 7 is a view like that of FIG. 5 of a fourth embodiment of the invention.

FIG. 5 is a side elevational view and FIG. 6 a top plan view of a sheet gripper 1 with parts known hereinbefore from FIGS. 1 and 2. One end of the bolt 7 is securely fastened in the bore 6 of the sheet-gripper screw-on port 5. The other end of the bolt 7 is mounted in the sheet gripper head 4 so as to be swivellable about the longitudinal axis 13 of the sheet gripper 1. A clamping sleeve or spline 15 ensures a firm connection between the sheet gripper screw-on part 5 and the sheet-gripper head 4. A friction and clamping force, respectively, of desired strength is thus able to be attained via a threaded pin 16 on the bolt 7 rotatably mounted in the sheet-gripper screw-on part 5.

Figure 8:
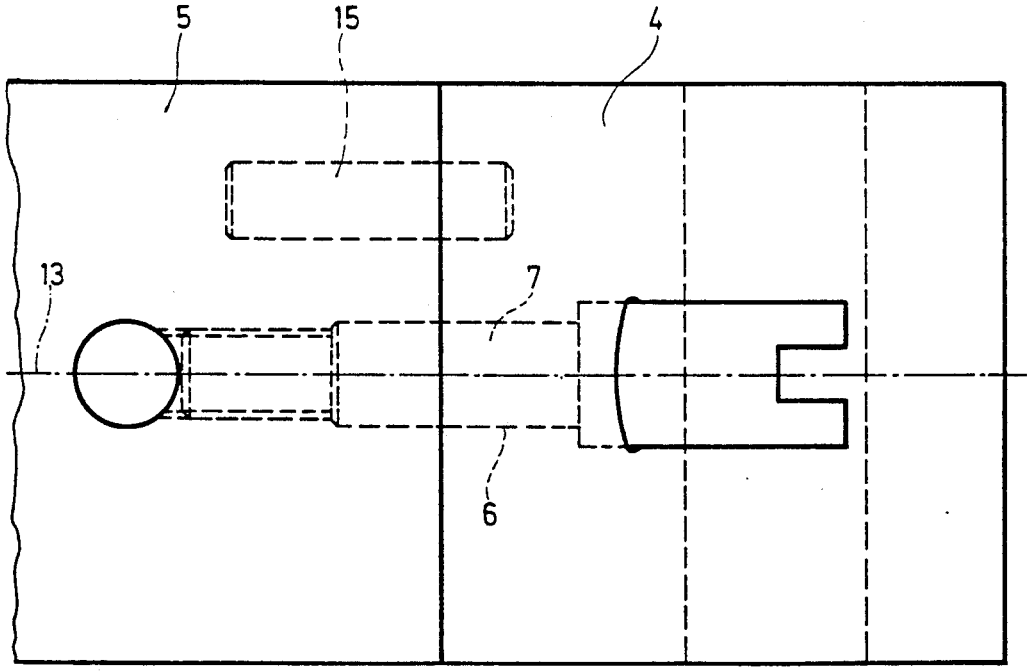
FIG. 8 is a top plan view of FIG. 7.
Figure 10:
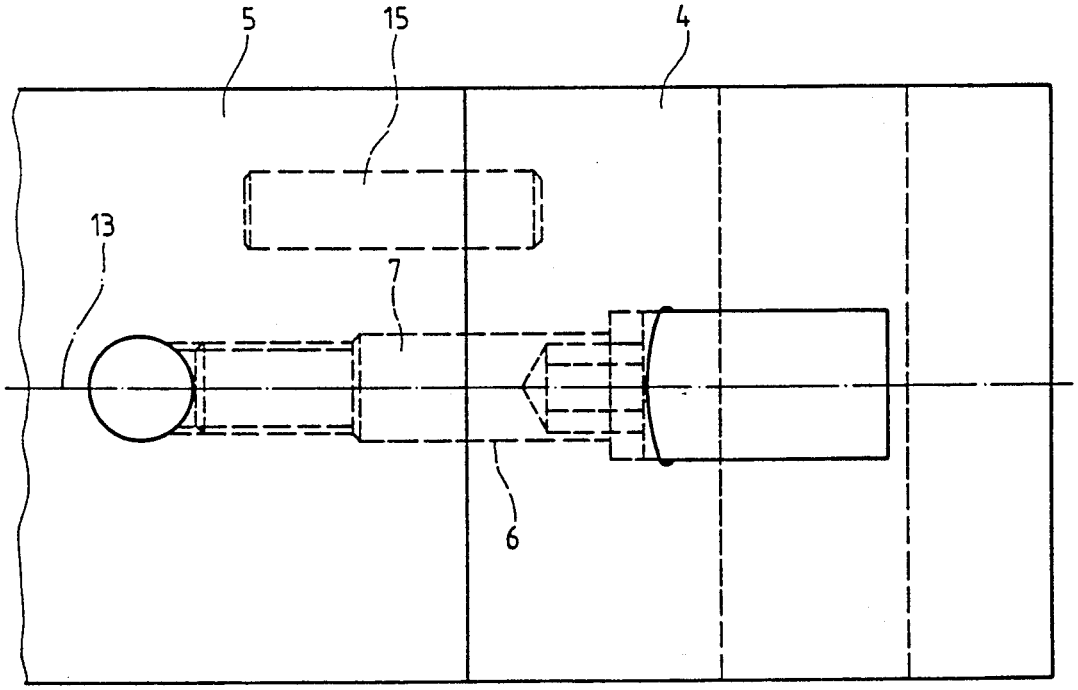
FIG. 10 is a top plan view of FIG. 9.

FIG. 10 is a side-elevational view and FIG. 8 a top plan view of a sheet gripper 1 with the parts described hereinbefore with respect to FIG. 3. In this embodiment, too, a clamping sleeve or split spline 15 serves for connecting the sheet-gripper head 4 and the sheet-gripper screw-on part 5. The adjustment of the starting or tightening force is effected through the intermediary of the bolt 10.

Figure 9:
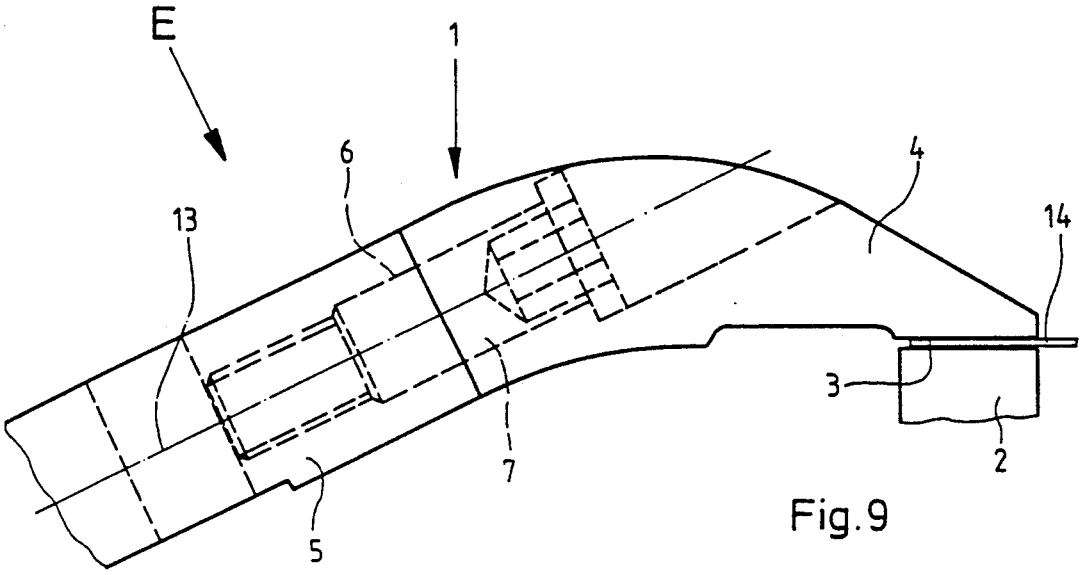
FIG. 9 is a view like that of FIG. 5 of a fifth embodiment of the invention.

In FIGS. 9 and 10, a fifth embodiment of the sheet-gripper device according to the invention is shown in a side elevational view (FIG. 9) and a top plan view (FIG. 10). In this embodiment, the bolt 7 is in the form of a hollow screw, for example. If necessary, it is possible thereby to replace or exchange the sheet-gripper head 4.

I claim:

1. Sheet-gripper device for sheet-fed rotary printing presses formed of a sheet gripper and a sheet-gripper seat, the sheet gripper having a longitudinal axis and comprising a sheet-gripper head and a gripper support part mutually engageable in a common plane transverse to said longitudinal axis, the sheet gripper being displaceable so that said sheet-gripper head thereof is movable towards the sheet-gripper seat for gripping a sheet therebetween, and away from the sheet-gripper seat for releasing the sheet, means for affording a swivelling of said sheet-gripper head and said gripper support part relative to one another about the longitudinal axis of the sheet gripper, and means for frictionally holding said sheet-gripperhead on said gripper support part.

2. Sheet-gripper device according to claim 1, wherein said holding means comprise a connecting member for connecting said sheet-gripper head to the gripper support part by friction.

3. Sheet-gripper device according to claim 1, wherein said holding means comprise an axial connecting part rigidly connected to said sheet-gripper head and swivellably mounted in said gripper support part.

4. Sheet-gripper device according to claim 1, wherein said holding means comprise an axial connecting part rigidly connected to said gripper support part, and said sheet-gripper head being mounted so as to be swivellable about said connecting part.

5. Sheet-gripper according to claim 2, including a bolt extending transversely to said connecting member and engaging in a slot formed on a side of said sheet gripper.

6. Sheet-gripper device according to claim 2, including means for adjusting the friction between said gripper support part and said sheet-gripper head.

7. Sheet-gripper device according to claim 2, wherein said sheet-gripper head is replaceable by another sheet-gripper head.

8. Sheet-gripper device for sheet-fed rotary printing presses formed of a sheet gripper and a sheet-gripper seat, the sheet gripper having a longitudinal axis and comprising a sheet-gripper head and a gripper support part, means for affording a swivelling of said sheet-gripper head and said gripper support part relative to one another about the longitudinal axis of the sheet gripper, and means for frictionally holding said sheet-gripper head on said gripper support part, hard-rubber springs carried by at least one of said gripper support part and said sheet-gripper head for generating friction therebetween.

9. In a sheet-gripper device for a sheet-fed rotary printing press, a sheet gripper and a sheet gripper seat, said sheet gripper having a longitudinal axis and comprising a sheet-gripper head and a holder therefore threadedly secured thereto and being mutually engageable in a common plane transverse to said longitudinal axis, the sheet gripper being displaceable so that said sheet-gripper head thereof is movable towards the sheet-gripper seat for gripping a sheet therebetween, and away from the sheet-gripper seat for releasing the sheet, means for frictionally retaining said sheet-gripper head in said holder, and means for affording a swivelling of said sheet-gripper head and said gripper support part relative to one another about the longitudinal axis of the sheet gripper.

10. A sheet gripping device comprising a sheet gripper and a sheet gripper seat, said sheet gripper having a longitudinal axis, said sheet gripper comprising a sheet gripper head having a threaded bore therein, a gripper support part comprising a threaded bolt which mates with said threaded bore and a gripper clamping surface disposed in a plane which intersects said longitudinal axis, means for allowing said gripper head and said gripper support part to be swivelled relative to each other about said longitudinal axis of said sheet gripper, and means for frictionally holding said sheet gripper head on said gripper support part in addition to the threaded relationship between said gripper support part and said gripper head.

* * * * *